US005352085A

United States Patent [19]

Sargent et al.

[11] Patent Number: 5,352,085

[45] Date of Patent: Oct. 4, 1994

[54] SHEET TRANSFER METHOD AND SYSTEM THEREOF

[75] Inventors: Max L. Sargent; Ervin P. Koone, both of Greenwood, S.C.

[73] Assignee: Fuji Photo Film, Inc., Greenwood, S.C.

[21] Appl. No.: 107,598

[22] Filed: Aug. 18, 1993

[51] Int. Cl.[5] ..... B65H 3/00

[52] U.S. Cl. ..... 414/796; 414/797.2; 271/6

[58] Field of Search ..... 271/6, 7, 200, 201, 271/275, 157, 158; 414/794.5, 794.6, 796.7, 796, 796.5, 797.2

[56] References Cited

U.S. PATENT DOCUMENTS

| | | | |
|---|---|---|---|
| 3,209,924 | 10/1965 | Hawkes | 414/796 |
| 3,209,931 | 10/1965 | Hawkes | 214/152 |
| 4,055,258 | 10/1977 | Schneider | 214/8.5 C |
| 4,314,696 | 2/1982 | Graef | 271/275 |
| 5,238,350 | 8/1993 | Krieg et al. | 414/797.2 |

*Primary Examiner*—H. Grant Skaggs
*Attorney, Agent, or Firm*—Burns, Doane, Swecker & Mathis

[57] ABSTRACT

A sheet transfer method for carrying a predetermined number of sheets from a destacking position to a restacking position by a vertically and horizontally movable transfer unit incorporating an entry-conveyor, a mid-conveyor, and an exit-conveyor. In this method, at the time of destacking a pile from the remaining stack, the advance of the transfer unit from one end to the other end of the stack, and the rotation of the pair of the entry-conveyor and mid-conveyors are concurrently effected substantially at the same speed, but in directions opposite to each other until the pile is progressively supported on the mid-conveyor. After the arrival of the transfer unit at the restacking position, the retraction of the transfer unit toward the destacking position, and the actuation of the pair of the mid-conveyor and exit-conveyor are concurrently effected substantially at the same speed, but in directions opposite to each other until the pile is clear of the transfer unit.

10 Claims, 6 Drawing Sheets

SHEET TRANSFER METHOD AND SYSTEM THEREOF

BACKGROUND OF THE INVENTION

1. Field of the Invention

This invention relates to a sheet transfer method for transferring piled sheets in units of a predetermined number, and a system thereof.

2. Description of the Related Art

There has been widely known a method in which piled sheets are deposited on a belt conveyor or a roller transfer unit for transferring purposes. However, such a conventional technique has a drawback in that the edges of the pile are tilted during the transfer. This problem is hereinafter referred to as unalignment. In order to obviate such unalignment, it is necessary to effect the realignment of the edges of the tilted pile at a subsequent step, and to have the realigned pile subjected to a process such as packaging, drilling, cutting or the like. As a much simpler and general method, sheets are transferred by hands.

In some applications where products include high quality surface decorative sheets, whose surfaces have undergone a special processing or coating, and presensitized printing plates to which a photosensitive resin has been applied, there has been a longstanding demand for a transfer system which is capable of transferring a pile from one process to the next process during the manufacture thereof with the edges of the products aligned.

During the transfer of piled sheets to a subsequent process, there has been a common practice, in order to prevent the unalignment of the pile, to attach tapes to a plurality of locations along the edge of the pile or to clamp the pile with a clamper. However, in view of the quality and appearance, the attachment of tapes is restricted to certain applications. Meanwhile, clamping the pile may cause the products to be deformed or damaged, and has a drawback in the time required for the mounting and dismounting of the clamps.

Alternatively, there may be considered other transfer techniques such as the dragging of a pile with a clamper or the deposition of a pile on a movable air table by introducing the table into a stack of sheets. These alternatives, however, involve the drawing of a pile which in turn may lead to the surface of a product being damaged.

In the field of products interested in this application, a protective sheet, called an interleaf, is usually inserted between sheets in order to protect the surface of the sheet from damage. During the transfer, however, the lowermost sheet of a pile is transferred without such an interleaf, so that the lowermost sheet is directly brought in contact with transfer rollers or an air table. This renders the quality of the lowermost sheet least ensured, and hence operators manually carry such products. With great care, the operators manually transfer the products so as not to disturb the integrity of each pile of sheets. As such, this manual operation results in muscular fatigue, known as CTD, or cumulative trauma disorder.

In addition to the above-mentioned alternatives, there is proposed a transfer system wherein operations are automated by robots, but this system requires a great amount of investment.

Examples of existing transfer techniques include U.S. Pat. No. 3,209,931, issued to Hawkes, wherein piles of flexible sheets are unstacked, trimmed and restacked by the use of a straddling type transfer table. This patent, however, discloses no teaching about the actuation of a transfer unit associated with the actuation of the loading and unloading subsections housed therein, substantially at the same speed in directions opposite to each other, to destack and restack a pile to be transferred without kinks in the pile or scratches on the topmost sheet of the remaining stack. Moreover, this method is disadvantageous in that the front end of the table is forcibly wedged into a stack overcoming friction, which causes the pile to be damaged or deformed.

In addition to the above, U.S. Pat. No. 4,055,258, issued to Schneider, discloses a sheet material destacking machine. This machine includes a hydraulically-driven gripping device which clamps a partial stack, preliminarily segregated by a separating roller, to complete the separation of the partial stack from the remaining stack. This machine inevitably suffers, when it is employed in the field of products interested in the present application, from the same drawbacks as already mentioned above, that is, the deformation or damaging of the products by the clamp.

SUMMARY OF THE DISCLOSURE

In view of the foregoing descriptions and observations, an object of this invention is to provide a sheet transfer method, as well as a system thereof, which permits the transfer of a pile of sheets, while being aligned, without tapes or clamps.

Another object of this invention is to provide a sheet transfer method which can protect products from damages resulting from contact between a pile of sheets to be transferred and the remaining stack.

Still another object of this invention is to provide a sheet transfer system useful in sorting, subdividing, or packaging products.

A further object of this invention is to provide a sheet transfer method, as well as a system thereof, which enables the transfer of sheets, such as presensitized plates, that has been hitherto carried out manually, to be economically mechanized, and which can contribute to the obviation of muscular fatigue.

To these ends, according to one preferred embodiment of this invention, there is provided a sheet transfer method wherein a pile of a predetermined number of sheet materials is transferred from a destacking position to a restacking position by means of a transfer unit which incorporates an entry-transfer section, a mid-transfer section, and an exit-transfer section, the method comprising the steps of:

lifting upwardly a leading edge of the pile, opposite to a front end of the entry-transfer section, and assisting the deposition of the pile onto the entry-transfer section;

advancing the transfer unit toward the opposite end of the pile associated with the actuation of the entry-transfer and mid-transfer sections in such a manner that the pile is progressively supported on the entry-transfer and mid-transfer sections, wherein the advance of the transfer unit and the actuation of the entry-transfer, mid-transfer, and exit-transfer sections are concurrently effected substantially at the same speed, but in directions opposite to each other;

halting the advance of the transfer unit and the actuation of the entry, mid, and exit-transfer sections when the pile is fully supported on the mid-transfer section;

moving the transfer unit to the restacking position with the pile held thereon until the transfer unit comes to a predetermined location on the restacking position; and retracting the transfer unit toward the destacking position associated with the actuation of the entry, mid, and exit-transfer sections so that the pile is progressively unloaded on the restacking position, wherein the retraction of the transfer unit and the actuation of the entry, mid and exit-transfer sections are concurrently effected substantially at the same speed, but in directions opposite to each other.

A constant clearance between the bottom of the transfer unit and the topmost sheet of the remaining stack should be preferably ensured by regulating the level of the transfer unit and the destacking and restacking positions.

According to a preferred mode of this invention, there is provided a sheet transfer system for transferring a pile of a predetermined number of sheet-like materials, which is separated from a stack of the materials, from a destacking position to a restacking position, the system comprising:

a pair of vertically movable table means located at the destacking and restacking positions, respectively, which support the pile of materials;

a transfer unit means which is horizontally movable along a guide means and vertically movable, and which incorporates an entry-transfer section, a mid-transfer section, and an exit-transfer section, wherein the advance of the transfer unit means and the actuation of the entry, mid, and exit-transfer sections are concurrently effected substantially at the same speed, but in directions opposite to each other;

a table driving means for actuation the tables;

a carriage means for driving back and forth the transfer unit means along the guide means between the destacking and the restacking positions;

a controller electrically connected to the table driving means and the carriage means for controlling the advance and retraction of the carriage means and the actuation of the entry-transfer, mid-transfer, and exit-transfer sections of the transfer unit.

There are two controlling means for this machine:

connecting the transfer unit means and the carriage means; and connecting the table means, the table driving means, sensor means, advance and retraction means of the carriage, the actuation of the entry-transfer, mid-transfer, and exit-transfer sections, and the vertical movement of the transfer unit means.

The two controllers communicate together to sequentially operate the machine.

The entry-transfer and exit-transfer sections of the transfer unit should preferably be formed in the shape of a wedge, thereby facilitating the drawing of the pile onto the entry-transfer section into the stack and the unloading of the pile from the exit-transfer section.

The angle of the wedged portion of the entry-transfer and exit-transfer sections should be in the range of ten to twenty degrees, and most preferably fifteen degrees.

A ratio of the carriage speed (Vf) to the speed (Vb) of the transfer sections of the transfer unit means should preferably be in the range of 0.94–0.98.

DETAILED DESCRIPTION OF THE PREFERRED EMBODIMENTS

Referring to the accompanying drawings, preferred embodiments of the present invention will be described in detail herein below.

Figure 1:
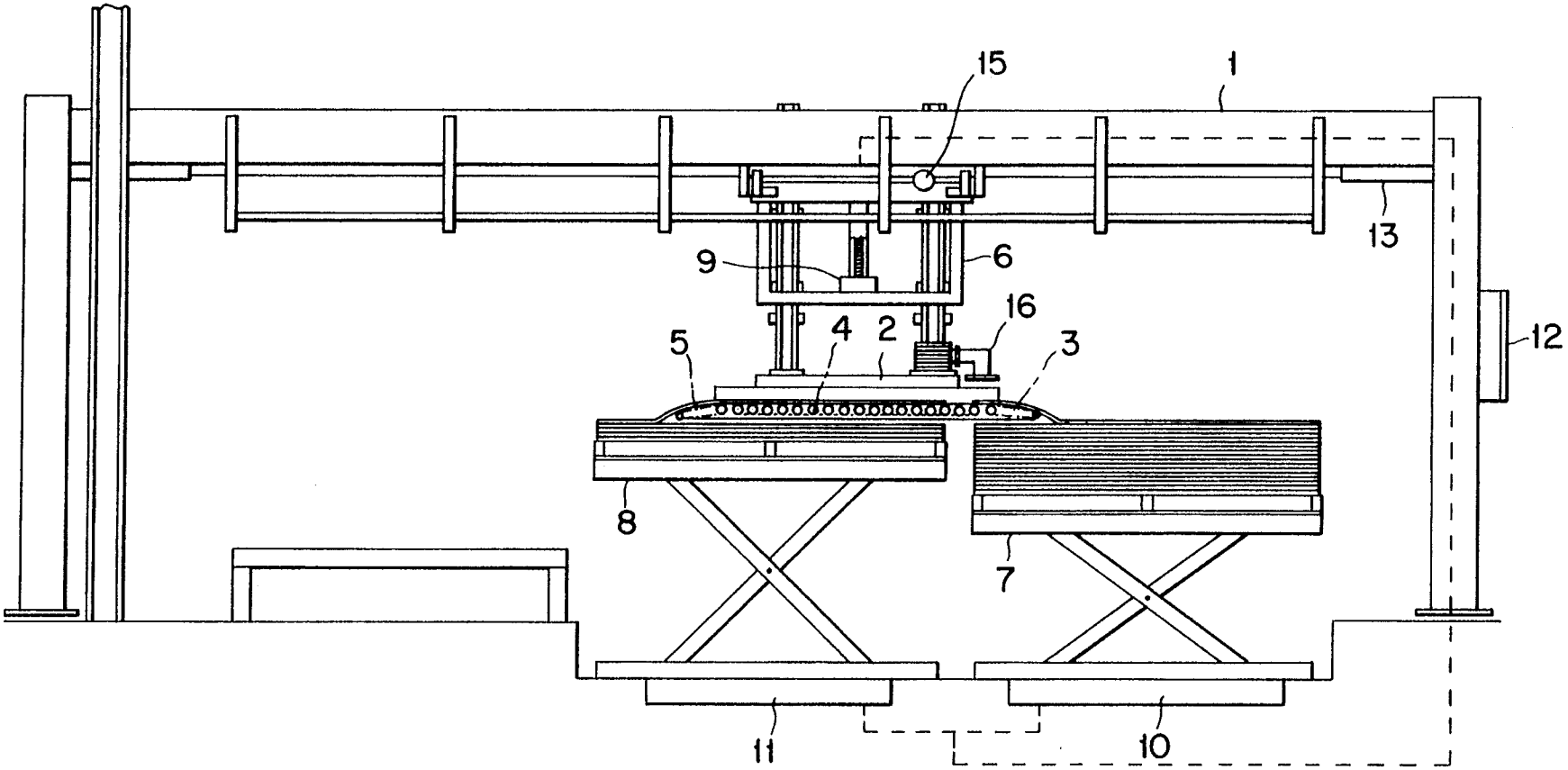
FIG. 1 is a schematic side elevation view showing a sheet transfer system according to the present invention.

In FIG. 1, a sheet transfer system 1, according to a preferred embodiment of the present invention, includes a vertically movable transfer unit 2 for carrying a pile separated from a remaining stack. The transfer unit 2 includes an entry-conveyor 3, a mid-conveyor 4, and an exit-conveyor 5. A carriage 6 is horizontally movable, and advances back and forth the transfer unit 2 associated with the actuation of the entry-conveyor 3, the mid-conveyor 4, and the exit-conveyor 5. A vertically movable supply table 7 supports a stack of sheets, and a vertically movable receiving table 8 supports restacked sheets. The system 1 further includes a guide rail 13, along which the carriage unit 6 travels back and forth. A clearance sensor 14 (shown in FIG. 2) detects a clearance between a bottom surface of the transfer unit 2 and a topmost surface of the remaining stack.

The sheet transfer system 1, according to this embodiment, includes a supply table driving means 10 and a receiving table driving means 11, both of which are electrically connected to a controller 12 of a known type, e.g., a microcomputer. The driving means 10, 11 hydraulically actuate the supply table 7 and the receiving table 8, respectively, under the control of the controller 12. The sheet transfer unit 2 is provided with an actuator means 9, which is electrically connected to the controller 12. The actuator means is preferably a screw actuator drive motor for vertically actuating the transfer unit 2 under the control of the controller 12, and is provided with a conveyor actuator drive 16 of a known type. The carriage conveyor 6 has its own drive which is interfaced with controller 12 for driving the carriage 6 under the control of the controller 12.

The entry-conveyor 3, the mid-conveyor 4 and the exit-conveyor 5 are preferably belt conveyors. However, they may be comprised of a combination of rollers. The entry-conveyor 3 and exit-conveyor 5 should preferably be formed in the shape of a wedge, thereby facilitating the destacking of the pile by the entry-conveyor 3 and the restacking of the pile by the exit-conveyor 5. The angle of the ends of the entry-conveyor 3 and exit-conveyor 5 should preferably be set to, at most, twenty degrees, and most preferably be set to 15 degrees. If the entry-conveyor 3 or exit-conveyor 5 have angles beyond the above maximum angle, the pile of sheets may be kinked.

The principle operation of the sheet transfer system according to this invention will be described hereunder.

In operation, two operators, each standing on respective sides of sheets piled on a supply table 7, manually lift up the leading edge of a predetermined number of sheets from the pile, opposite the front end of the entry-conveyor 3, to create an opening in the stack. In this embodiment, each sheet has a maximum width of 57.88 inches, a maximum length of 77.38 inches, a maximum thickness of 0.020 inches, and a maximum weight of 200 pounds. The number of stacked sheets should preferably be in the range of fifteen to fifty.

Figure 2:
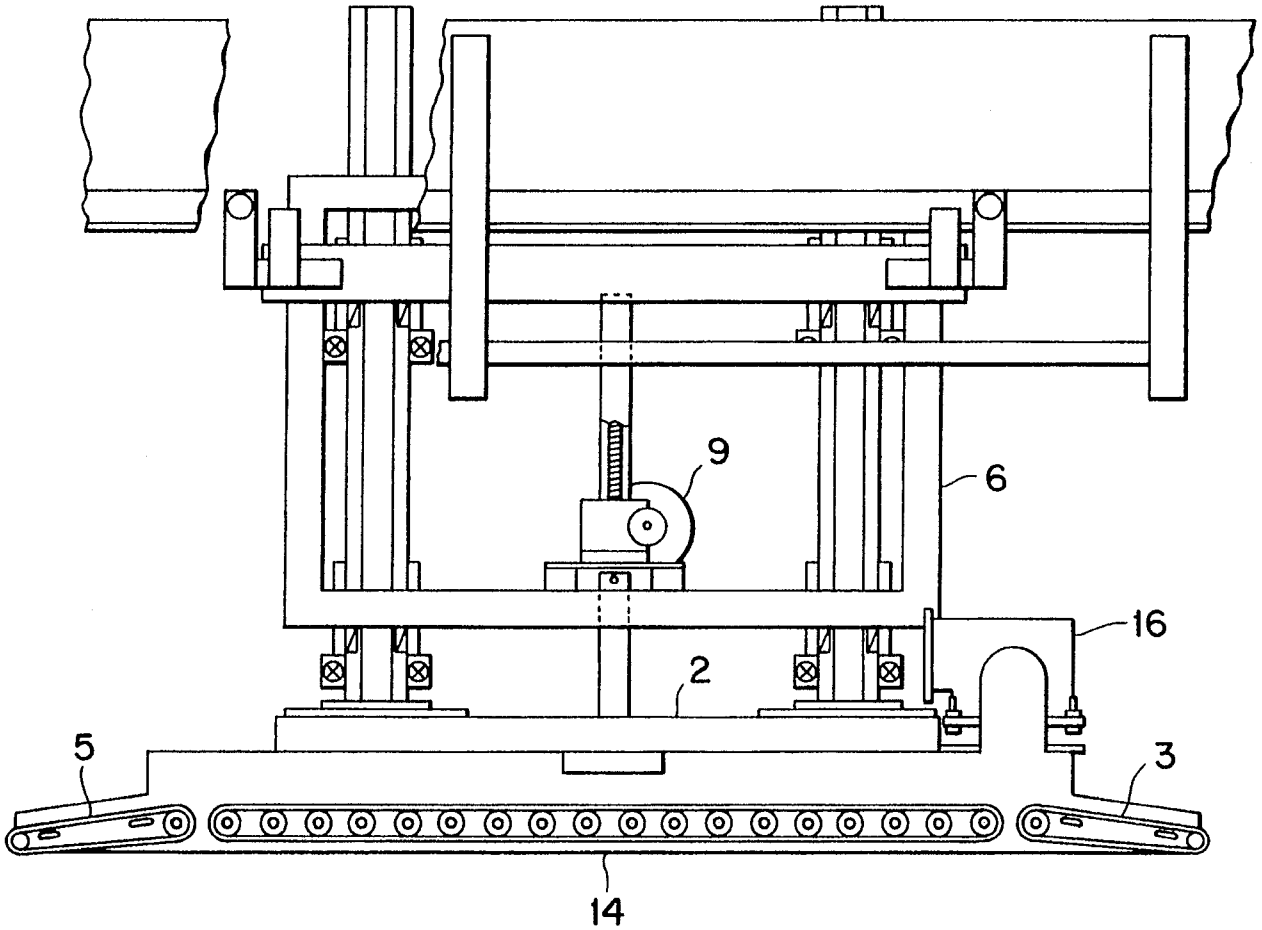
FIG. 2 is a partially enlarged and cut-away view of a transfer unit and a carriage of the transfer system shown in FIG. 1.
Figure 3:
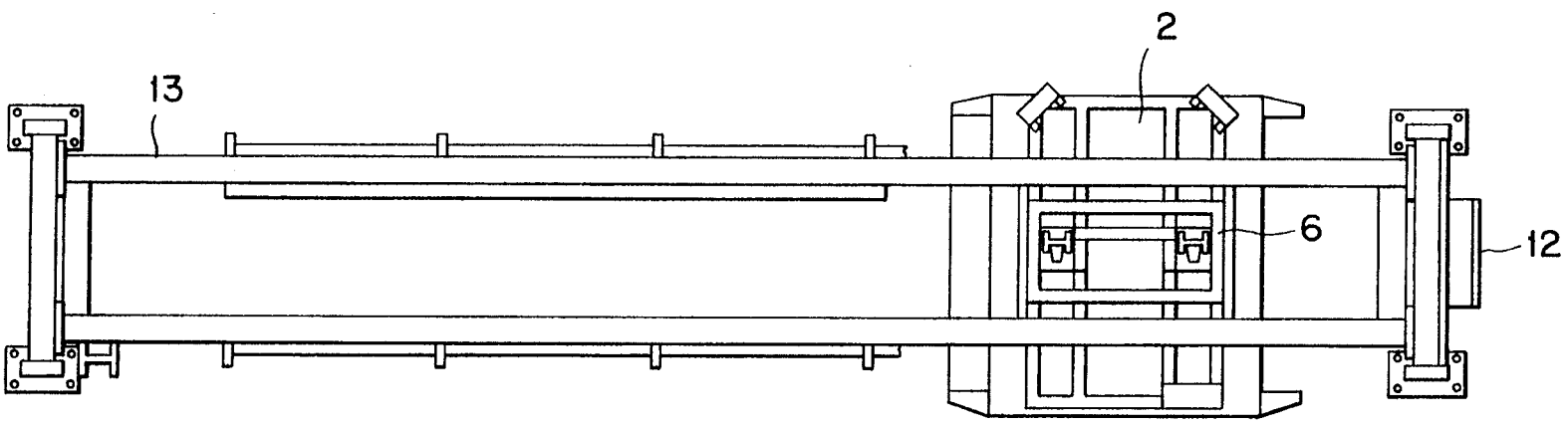
FIG. 3 is a top plan view of the sheet transfer system shown in FIG. 1.
Figure 4A:
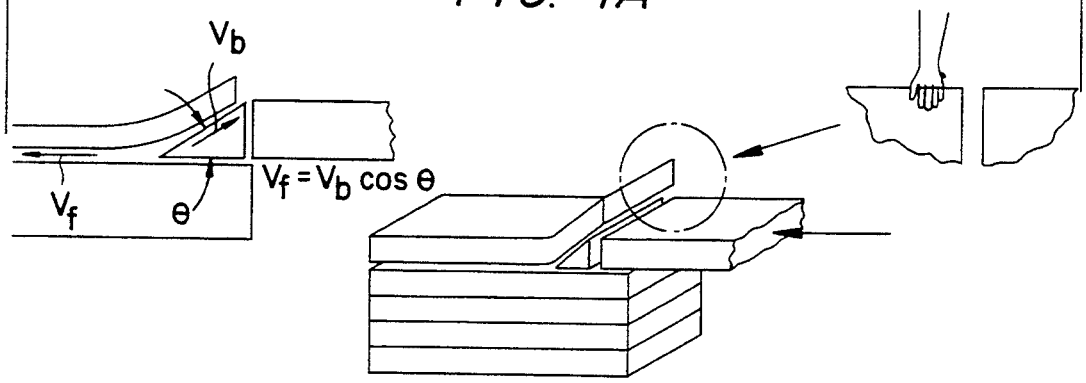
FIGS. 4*a*–4*f* diagrammatically illustrate destacking and restacking operations by means of the transfer unit according to the present invention.
Figure 4B:
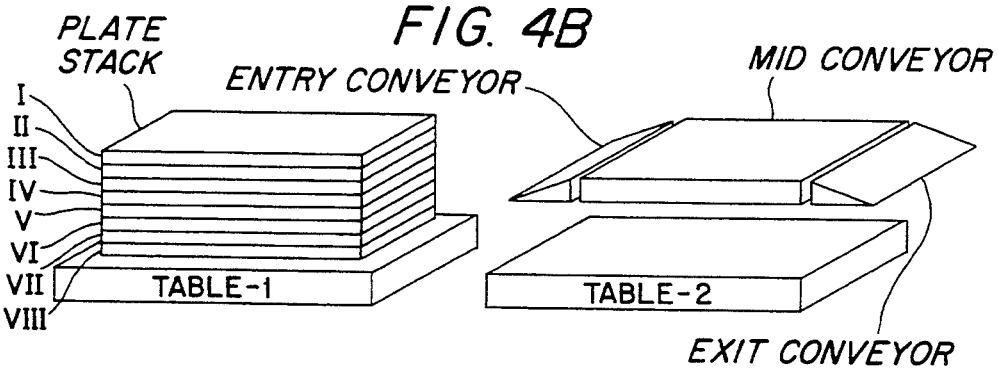
Figure 4C:
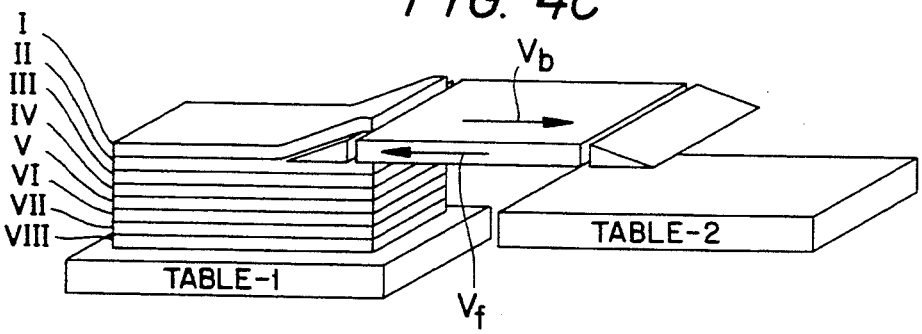
Figure 4D:
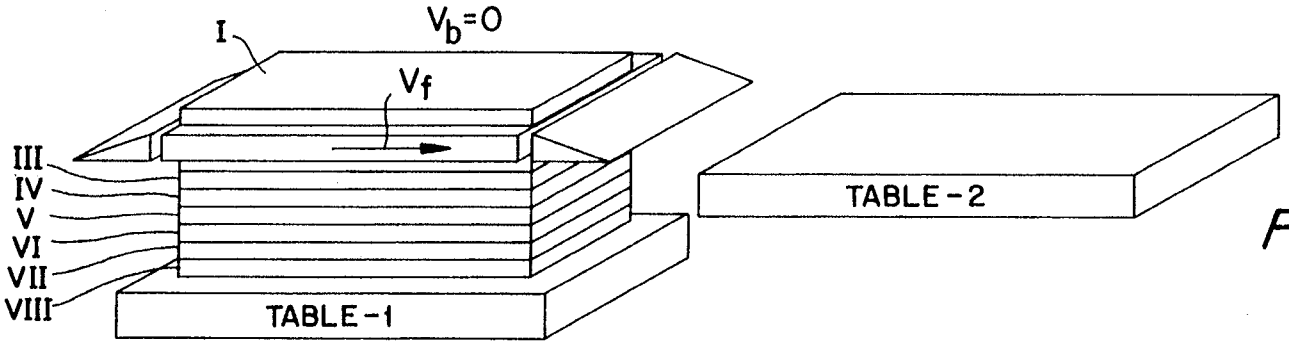
Figure 4E:
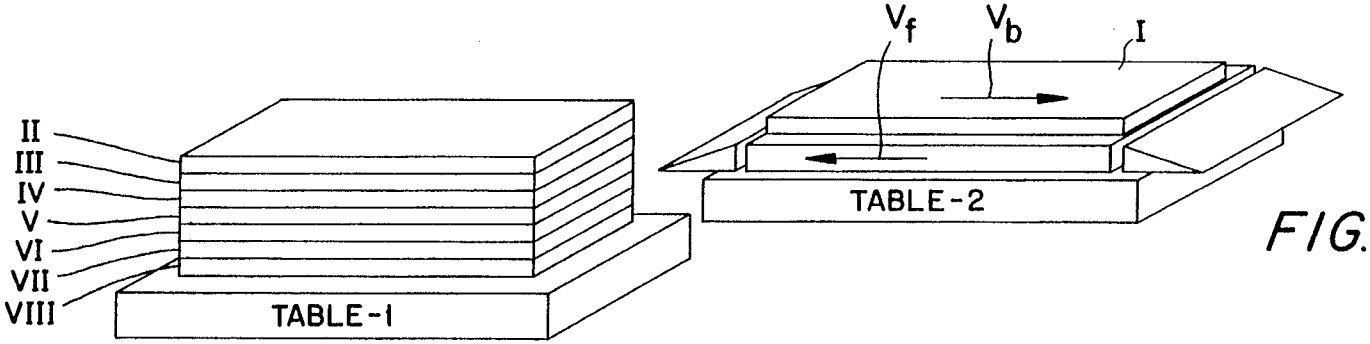
Figure 4F:
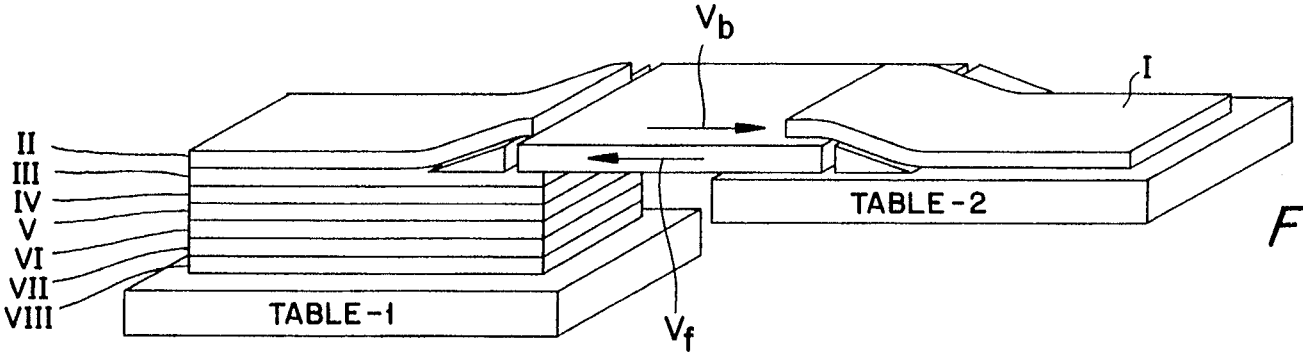

The carriage 6 advances the transfer unit 2, positioned at a destacking position, into the opening of the stack from one end to the other preferably at a speed of about 19.0 m./min. so that the lifted leading edge of the pile is manually deposited onto the wedge-like entry-conveyor 3, as shown in FIG. 2. Associated with the advance of the transfer unit 2, the entry-conveyor 3 and the mid-conveyor 4 are also actuated at substantially the same speed as the advance of the transfer unit 2, that is, at a speed of about 20.0 m./min. However, the top surfaces of the conveyors move in a direction opposite to the direction in which the transfer unit is advanced.

Continued advance of the transfer unit 2 toward the other end of the pile, associated with the actuation of the entry-conveyor 3 and the mid-conveyor 4, causes the pile to be moved progressively onto the conveyors 3, 4, 5.

During the advance of the transfer unit 2, the clearance between the bottom surface of the transfer unit 2 and the topmost sheet of the remaining stack is constantly detected by a known sensor 14, e.g., an optical sensor or the like, situated on the bottom surface of the transfer unit 2. In response to a result detected by the sensor 14, the controller 12 supplies a signal both to the actuator means 9 and the supply table drive means 10 so as to ensure a constant clearance.

After the pile is completely on the conveyors, the controller 12 controls the carriage drive 15 so as to move the transfer unit 2 to the restacking position, that is, the receiving table 8. The carriage 6 can travel at a speed of about 25.4 m./min, carrying the pile deposited on the mid-conveyor 4. The speed (Vf) of the carriage 6 is preferably in the range between 12.7 m./min and 25.4 m./min, and preferably about 19.0 m./min.

At the restacking end, the levels of the receiving table 8 and the transfer unit 2 are adjusted by means of the receiving table driving means 11 and the actuator means 9 under the control of the controller 12 so that a constant clearance is ensured between the bottom surface of the transfer unit 2 and the topmost surface on the receiving table 8.

Upon arrival of the transfer unit 2 at the restacking position, the actuation of entry-conveyor 3, mid-conveyor 4 and exit-conveyor 5 is started in association with the retrogression of the transfer unit 2. The advance of the transfer unit 2 is effected in a direction opposite to the direction in which top surfaces of the conveyors 3, 4, and 5 10 move, but substantially at the same speed. Specifically, the unit 2 is retracted backwardly at a speed (Vf) of about 19.0 m./min, and the conveyors 3, 4, and 5 are actuated at a speed (Vb) of about 20.0 m/min. The ratio of the carriage speed (Vf) and the conveyor speed (Vb) during the destacking and restacking operations should preferably be 0.95:1.00. In practice, the conveyor speed (Vb) should preferably be slightly greater than the carriage speed (Vf), whereby the pile can be transferred with the leading and trailing edges thereof being neatly aligned.

Figure 5A:
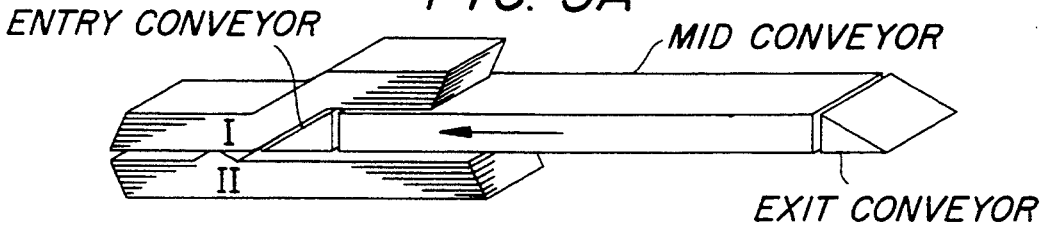
FIGS. 5*a*–5*e* diagrammatically illustrate destacking and unloading operations by the transfer unit according to this invention, wherein the ratio of the rotating speed of the conveyor and the advancing speed of the carriage are equal or greatly different.

As shown in FIG. 5*a*, if the carriage 6 advances the transfer unit 2 at a speed greater than the rotating speed (Vb) of the pair of the entry-conveyor 3 and mid-conveyor 4, the leading edge of the entry-conveyor 3 is wedged into an opening in the stack of sheets, whereupon the lower part of the pile to be transferred receives a much greater force resulting from wedging action when compared with the upper part of the same, thereby causing the lower part of the pile to be kinked which, in turn, leads to the upper part of the pile being tilted toward the front end of the entry-conveyor 3. This kinked portion of the pile also exerts a force on the part of the upper part of the remaining stack being in close proximity to the front end of the entry-conveyor 3, thereby causing this part of the upper stack of sheets to be out of alignment.

Figure 5B:
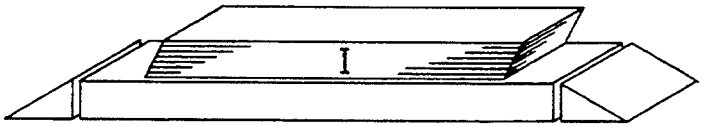
Figure 5C:
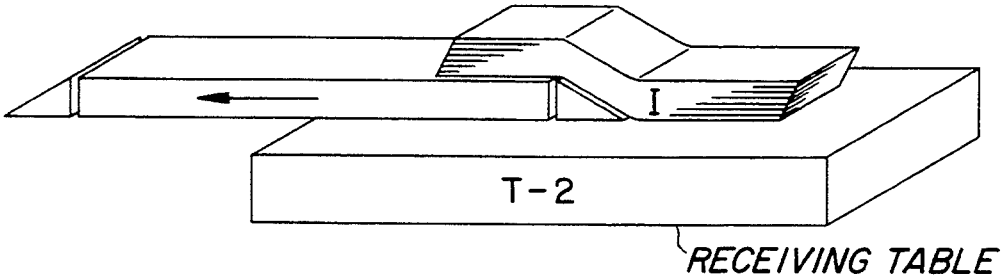
Figure 5D:
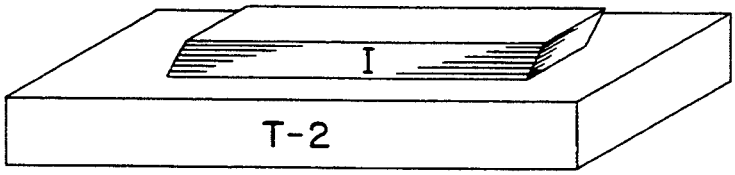

FIGS. 5*b*–5*d* illustrate the transfer of the pile thus destacked and the restacking of the same. If the exit-conveyor 5 unloads the pile at a speed less than the retracting speed (Vf) of the carriage 6, the lower part of the pile receives a much greater rearward force as compared with the upper part of the same, whereupon the lower part of the pile is further drawn toward the destacking position, thereby increasing a dislocation between the upper and the lower ends of the pile.

Figure 5E:
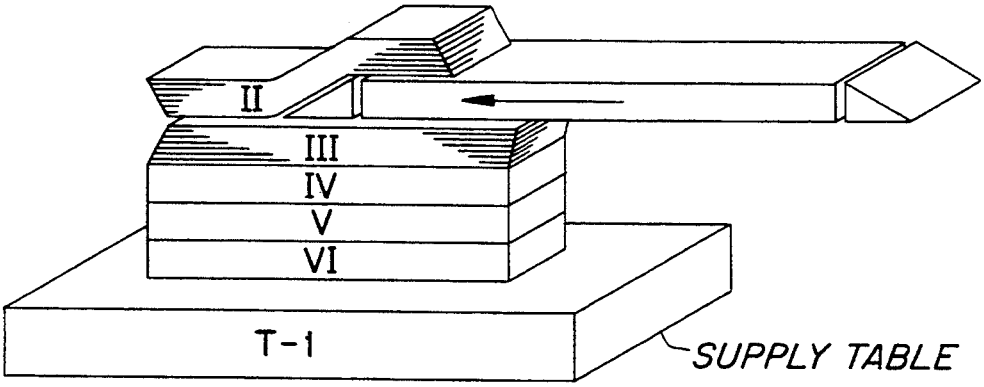

To the contrary, as shown in FIG. 5*e*, if the entry-conveyor 3 rotates at a speed (Vb) greater than the advancing speed (Vf) of the carriage 6, the upper part of the pile is tilted toward a direction opposite to the front end of the entry-conveyor 3. Continued advance of the carriage 6 causes the trailing edge of the remaining stack, opposite to the front end of the entry-conveyor 3, to be tilted similar to the pile, thereby leading to the pile being out of alignment.

Thus, as is evident from the above, a feature of this invention, that is, the advance of the carriage 6 and the rotation of the conveyor pair, at the same time in directions opposite to each other, substantially at the same speed, can ensure the transfer of piled products with the edges thereof being properly aligned, and can prevent the products from being damaged by kinks or scratches.

It will be understood that the above description of the present invention is susceptible to various modifications, changes, and adaptations and that the same are intended to be comprehended within the meaning and range of equivalents of the appended claims.

What is claimed is:

1. A sheet transfer method wherein a pile of sheet materials is transferred from a destacking position to a restacking position by means of a movable transfer unit which incorporates an entry-conveyor, a mid-conveyor, and an exit-conveyor, the method comprising the steps of:

lifting up a leading edge of the pile, opposite to a front end of the entry-conveyor and assisting deposition of the pile onto the entry conveyor;

advancing the transfer unit toward an edge of the pile that is opposite the leading edge of the pile, while actuating the entry and mid conveyors in such a manner that the pile is progressively supported on the entry and mid conveyors, wherein the advance of the transfer unit and the actuation of the pair of the entry and mid conveyors are concurrently effected substantially at the same speed; and further wherein the transfer unit and top surfaces of the conveyors are moving in directions opposite to each other;

halting the advance of the transfer unit and the actuation of the entry and mid conveyors when the pile is fully supported on the mid-conveyor;

moving the transfer unit to the restacking position with the pile held thereon until the transfer unit comes to a predetermined location at the restacking position; and retracting the transfer unit toward the destacking position while actuating the exit and mid conveyors so that the pile is progressively unloaded onto the restacking position, wherein the retraction of the transfer unit and the conveyors are concurrently effected substantially at the same speed, and further wherein the transfer unit and top surfaces of the conveyors move in directions opposite to each other.

2. The sheet transfer method of claim 1, further comprising the step of regulating levels of the transfer unit and the destacking and restacking positions to ensure a constant clearance between a bottom of the transfer unit and a topmost sheet on the destacking and restacking positions.

3. A sheet transfer system for transferring a pile of sheet materials from a destacking position to a restacking position, the system comprising:

a pair of vertically movable tables located at the destacking and restacking positions, respectively, which support the pile of materials;

a transfer unit which is horizontally movable and vertically movable, and which incorporates an entry-conveyor, a mid-conveyor, and an exit-conveyor;

table driving means for actuating the tables;

carriage means for driving back and forth the transfer unit between the destacking and the restacking positions;

control means electrically connected to the table driving means and the carriage means for controlling the advance and retraction of the carriage means and the actuation of the entry-conveyor, mid-conveyor and the exit-conveyor unit so that advancement of the transfer unit and actuation of the entry-conveyor and mid-conveyor, and the exit-conveyor, are concurrently effected substantially at a same speed, but wherein a direction of top surfaces of the conveyors is opposite to a direction of the transfer unit.

4. The sheet transfer system of claim 3, further comprising sensor means situated on a bottom surface of the transfer unit for detecting a clearance between the bottom surface and a topmost sheet of a remaining stack at the destacking position.

5. The sheet transfer system of claim 4, wherein the control means controls vertical movement of the tables to ensure a constant clearance.

6. The sheet transfer system of claim 3, wherein the entry and exit conveyors of the transfer unit are formed in the shape of a wedge.

7. The sheet transfer system claim 6, wherein an angle of the wedge of the entry and exit conveyors is set in the range of 10 to 20 degrees.

8. The sheet transfer system of claim 7, wherein the angle is set to 15 degrees.

9. The sheet transfer system of claim 3, wherein the control means includes means for controlling the ratio of a carriage speed (Vf) to a conveyor speed (Vb) of the transfer unit within the range of 0.94–0.98.

10. The sheet transfer system of claim 3, comprising a guide means extending between the destacking position and the restacking position for guiding the transfer unit.

* * * * *